US005096322A

United States Patent [19]

Shiga et al.

[11] Patent Number: 5,096,322

[45] Date of Patent: Mar. 17, 1992

[54] NIB FOR A WRITING INSTRUMENT

[75] Inventors: Hiroyuki Shiga, Kita; Masayuki Kawasaki, Miyashirocho, both of Japan

[73] Assignee: Pentel Kabushiki Kaisha, Tokyo, Japan

[21] Appl. No.: 626,223

[22] Filed: Dec. 7, 1990

Related U.S. Application Data

[63] Continuation of Ser. No. 777,638, Sep. 11, 1985, abandoned.

[30] Foreign Application Priority Data

| | | | |
|---|---|---|---|
| Sep. 27, 1984 | [JP] | Japan | 59-147224 |
| Sep. 27, 1984 | [JP] | Japan | 59-203483 |
| Oct. 30, 1984 | [JP] | Japan | 59-228388 |
| Oct. 31, 1984 | [JP] | Japan | 59-229763 |

[51] Int. Cl.[5] ..... B43K 8/00; B43K 8/06

[52] U.S. Cl. ..... 401/199; 401/261; 401/265; 401/292

[58] Field of Search ..... 401/198, 199, 258, 261, 401/265, 292

[56] References Cited

U.S. PATENT DOCUMENTS

| | | | |
|---|---|---|---|
| 168,407 | 10/1875 | O'Kane | 401/292 |
| 299,046 | 5/1884 | Alderman | 401/261 |
| 1,205,920 | 11/1916 | Miura | 401/258 |
| 2,396,058 | 3/1946 | Rath | 401/198 |
| 2,666,416 | 1/1954 | Rickmeyer | 401/198 X |
| 3,507,600 | 4/1970 | Cress | 401/258 |
| 3,520,629 | 7/1970 | Otsuka | 401/265 X |
| 3,614,248 | 10/1971 | Otsuka | 401/292 |
| 3,627,868 | 12/1971 | Funalashi | 401/265 X |
| 3,932,044 | 1/1976 | Otake et al. | 401/265 |
| 4,076,428 | 2/1978 | Otake et al. | 401/265 |
| 4,215,948 | 8/1980 | Horie et al. | 401/265 |
| 4,310,259 | 1/1982 | Ito et al. | 401/265 |
| 4,362,683 | 12/1982 | Otsuka et al. | 401/198 X |
| 4,597,685 | 7/1986 | Nakamura | 401/199 |

FOREIGN PATENT DOCUMENTS

| | | | |
|---|---|---|---|
| 167760 | 4/1950 | Austria | 401/292 |
| 827297 | 12/1951 | Fed. Rep. of Germany | 401/258 |
| 2547000 | 4/1976 | Fed. Rep. of Germany | 401/199 |
| 2558069 | 6/1977 | Fed. Rep. of Germany | 401/292 |
| 2535906 | 9/1977 | Fed. Rep. of Germany | 401/196 |
| 57926 | 9/1953 | France | 401/258 |
| 2350970 | 5/1976 | France | 401/265 |
| 2376759 | 9/1978 | France | 401/196 |
| 265511 | 9/1951 | Japan | 401/199 |
| 2110203 | 9/1970 | Japan | 401/199 |
| 0197197 | 12/1982 | Japan | 401/198 |
| 396003 | 7/1933 | United Kingdom | 401/258 |
| 1112684 | 5/1965 | United Kingdom | 401/198 |

*Primary Examiner*—Steven A. Bratlie

*Attorney, Agent, or Firm*—Wenderoth, Lind & Ponack

[57] ABSTRACT

A ceramic nib for a writing instrument having a tapered outer surface which converges toward a writing point end to form a tapered point, and at least one ink passage extending along the length of the nib such that the ink passage is converged along with the convergence of the outer surface of the ceramic tapered point of the nib, the ink passage having a bottom surface which is tapered such that it becomes more narrow towards the tapered point.

9 Claims, 5 Drawing Sheets

NIB FOR A WRITING INSTRUMENT

This application is a continuation of now abandoned application, Ser. No. 06/777,638 filed on Sept. 11, 1985.

BACKGROUND OF THE INVENTION

The present invention relates in general to a writing instrument and more particularly to a writing instrument nib which has an ink feeding groove or grooves on the outer surface thereof. Further, the present invention relates to a writing nib, the outer surface of which is converged toward a writing point thereof.

A known nib of the type described above is, for example, a nib made of a synthetic resin which is formed by extrusion molding, cutting to a predetermined length and shaping the cut portion. The synthetic resin nib has various shapes such as a conical shape, cannon-ball shape having a tapered or converged end for a writing point.

The synthetic resin nib has ink feeding channels or passages. Some resin nibs have an ink passage or passages at a longitudinally central portion thereof, and others do not have a passage or passages at the central portion thereof. The latter type of nib provides more desirable mechanical strength properties since a writing point of the nib is formed by the resin material at the central portion. In addition, the resin nib provides a desired resiliency so that a larger area of the writing point contacts a paper or the like.

However, one of the most serious problems inherent in the synthetic reisn nib is its poor wearing property.

A representative example of a nib having a remarkable resistance to wear is a ceramic nib, which is conventional and is disclosed in, for example, Japanese Patent Publication No. 26-5511 published in 1951.

However, a problem which still remains with this type of ceramic nib is that it is unreliable since it lacks flexibility and it is difficult to prevent foreign particles from becoming blocked in the ink channels of the nib.

Recently, a new type of ceramic nib has been proposed which is cylindrical and has a central aperture for an ink channel with a pin or a longitudinal element which is slidably inserted into the ink channel to thereby overcome the problem the ink channel due to blocking of foreign particles. This type of cylindrical is more reliable in ink feeding but still has a problem in that it is rather difficult to produce a thin tubular nib for a thin or slender writing.

SUMMARY OF THE INVENTION

An object of the present invention is to provide a new ceramic writing nib which has a good wearing property and a reliable ink feeding function.

Another object of the present invention is to provide a ceramic writing nib of a simple construction.

Another object of the present invention is to provide a ceramic writing nib which can prevent drying of ink within a writing instrument.

A further object of the present invention is to provide a ceramic writing nib which is suitable not only for a thick writing but also for thin or slender writing.

According to the present invention, there is provided a ceramic nib which has an outer surface converged toward its writing point to form a tapered point, and at least one ink passage extending along its length such that the ink passage is converged along with the convergence of the outer surface of the ceramic writing point.

In a preferred embodiment, the ceramic nib has a porosity of about 2% to about 10%. Preferably, the nib has a plurality of longitudinal legs extending radially outwardly to form the aforementioned at least one ink passage. The legs have, at their extended ends, projections extending toward the adjacent legs so that the ink passage is narrowed at its outer portion by the projections. The projections are formed at a rear portion of the nib which is distal to the writing point of the nib.

In an embodiment of the invention, the ink passage has an angled recess along the bottom surface thereof. The ink passage may terminate at a portion which is spaced from the writing point of the nib so that an ink passage is not formed at the writing point.

In the present invention, the nib can be produced by the steps of partly stretching a ceramic product composed mainly of sintered powder and an excipient such as a binder, and sintering the ceramic product.

PREFERRED EMBODIMENTS OF THE INVENTION

Preferred embodiments of the invention will be described with reference to the drawings.

Figure 1:
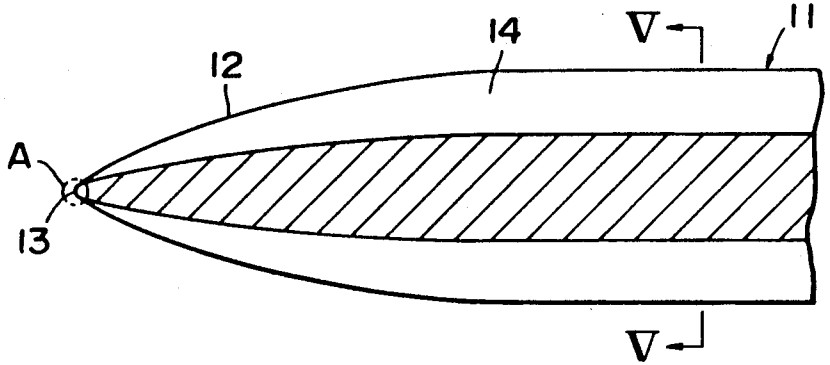
FIG. 1 is a longitudinally sectional view of a ceramic nib of the present invention.
Figure 2:
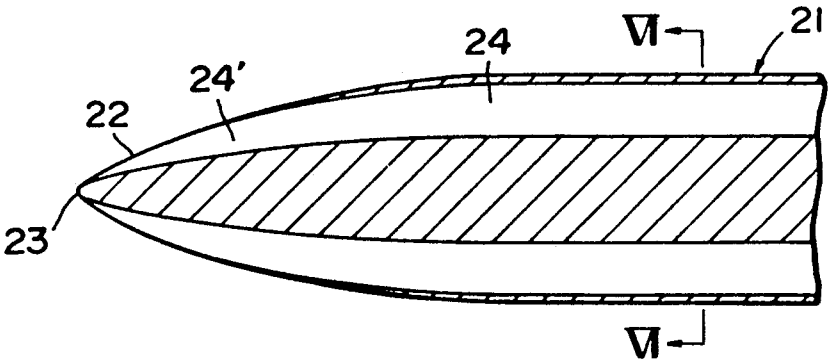
FIG. 2 is a longitudinally sectional view of a ceramic nib of another embodiment of the invention.

Referring first to FIG. 1, a nib 11 for a writing instrument is made of a ceramic which is selected from ceramics of oxides such as alumina, zirconia, and ceramics of non-oxides such as silicon nitride, etc. The nib 1 has a tapered portion 12 which is terminates in a "cannon ball" shaped writing point 13, and ink grooves 14 or channels are provided along the length of the nib, the ink grooves or channels having shapes which are converged along with the tapering or convergence of the tapered portion 12 of the nib. The nib has a porosity of preferably less than about 10%. Generally, lower porosity provides less generation of cracking, cutout and fracture. The ink grooves 14 can be open along the entire length of the nib as shown in the embodiment of FIG. 1, but it is not always necessary that the grooves be opened as described above. For instance, in the embodiment of FIG. 2, the ink channels 24 are formed into through-holes to a starting portion of the tapered portion 22 and then opened to form grooves 24' similar to the grooves 14 of the previous embodiment of FIG. 1. The ink grooves 14 and ink channels 24 can be formed with porous material of an open-cell type so as to improve retention of ink.

Figure 3:
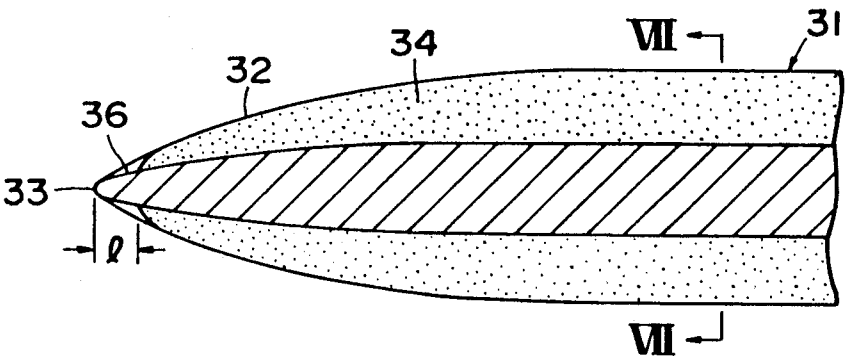
FIG. 3 is a longitudinally sectional view of a writing nib according to another embodiment of the invention.
Figure 4:
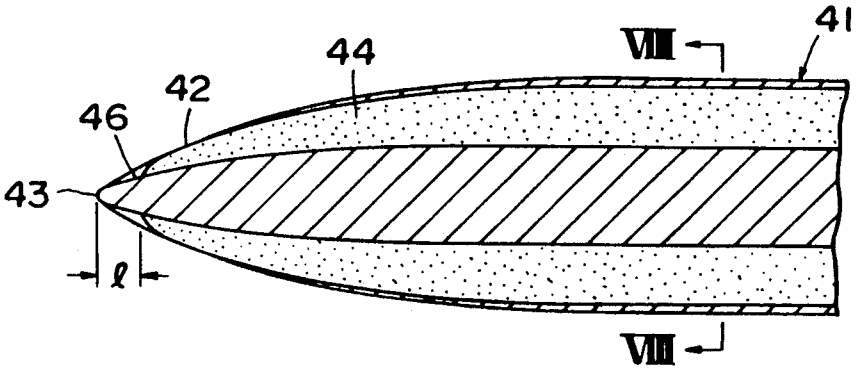
FIG. 4 is a longitudinally sectional view of a writing nib according to a further embodiment of the invention.

In the embodiments of FIGS. 3 and 4, the nibs 31, 41 have ink grooves 34, and channels 44, respectively, which are are filled with a porous material. The writing point portions 32, 42 of the nibs have non-porous portions 36, 46 which extend a distance "l" from the writing point 33, 43, the portion designated by reference character "l" being generally about 0.3 mm to 3.0 mm. This structure provides an advantage in that fewer foreign particles are trapped within the ink grooves and channels 34, 44 compared to a structure in which the ink grooves and channels 34, 44 are entirely formed of porous materials.

According to the present invention, the writing nib of a suitable ceramic has a tapered portion which converges toward the writing point and at least one ink passage which is in the form of a groove or through-hole or combination of both. The ink passage has a shape which tapers toward the writing point along with the tapering or convergence of the outer surface of the tapered portion of the nib. The combination of the ceramic material and the tapered shape of outer surface and groove results in a writing nib having a reliable ink feeding function.

Figure 9:
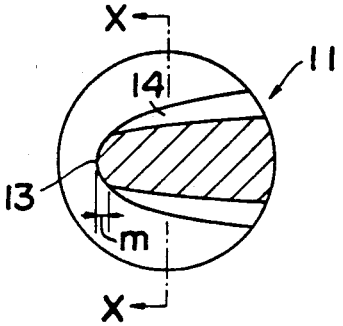
FIG. 9 is an enlarged longitudinally sectional view of the writing point of the nib shown in FIG. 1.
Figure 10:
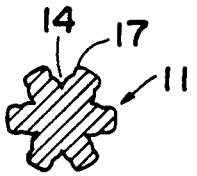
FIG. 10 is a cross sectional view taken along X—X in FIG. 9, FIGS. 11 and 12 are, similar to FIG. 5, cross sectional views of the nib according to another embodiment of the invention.

The ink grooves or channels, which will be referred to as ink passages hereinafter, will be explained with reference to FIGS. 1–4 and FIGS. 5–8. Although only one ink passage may be provided, it is preferred that a plurality of ink passages are formed so as to provide a larger writing point area which is capable of writing. With reference to the nib which has a substantially circular cross section as shown in FIGS. 5–8, it is preferable that 3 to 10, and more preferably 5 to 8, ink passages be formed. For example, with respect to the nib shown in FIG. 5, a total of six ink passages may be formed as the ink passages 14. The nib shown in FIG. 5 has a configuration such that the ink passages 14 are narrowed at their outer portions by projections 17 which are formed at the outer end of legs which extend radially outwardly between passages 14 so that drying of ink in the ink passages is restrained. However, it is preferred that the projections 17 are terminated at the front end portion of the ink passages for the purpose of preventing the invasion of foreign particles into the ink passages. As shown in FIGS. 9 and 10, projections 17 are not formed at the front end portion of the ink passages and the passages are not narrowed at their outer portions.

Figure 5:
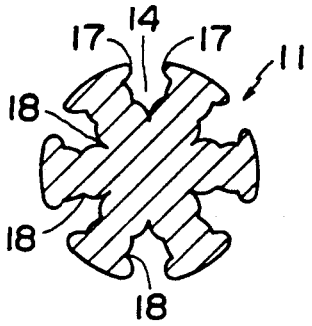
FIG. 5 is a cross sectional view taken along V—V in FIG. 1.
Figure 11:
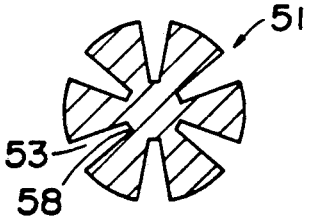

Besides, the nib shown in FIG. 5 has five angular portions or longitudinally extending crevices 18 in each ink passage 14 so that they function to provide a strong capillary action of ink in each of the ink passages 14. Preferably, at least one of the angular portions 18, including a case when only one angular portion is formed in all, is formed at the base or bottom of the ink passage 14. FIG. 11 shows an example in which two angular portions 58 are formed on the bottom of each ink passage 53.

The ink passages have an analogous shape in cross sections at the respective portions along length of the tapered or converged portion of the nib, which will be explained with references to FIGS. 12–14. The bottom surface of an ink passage has minimum curvature portions lying in planes perpendicular to the longitudinal axis of the nib body, each of which becomes smaller as they approach the writing point of the nib. In the nib 61 shown in FIG. 12, reference character B shows the minimum curvature portion of the ink passages 63. The term "minimum curvature portion" includes the two angular portions 58 of the nib 51 shown in FIG. 11 and the angular portion 18 of the nib in FIG. 5, and it represents a portion of the ink passage which has the strongest capillary action within the passage.

Figure 13:
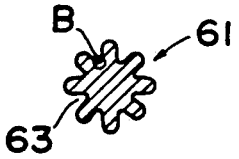
FIG. 13 is, similar to FIG. 10, a cross sectional view of the nib shown in FIG. 12.

The minimum curvature portion B has a smaller curvature as it extends toward the writing point as shown in FIG. 13.

Figure 12:
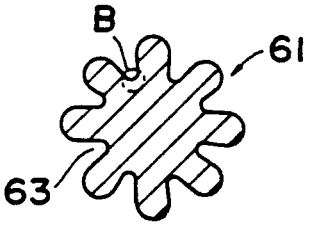
Figure 14:
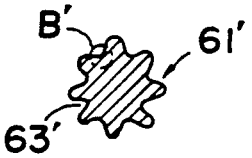
FIG. 14 is, for the purpose of comparison, a cross sectional view of the nib, which corresponds to the cross sectional view of FIG. 13.
Figure 15:
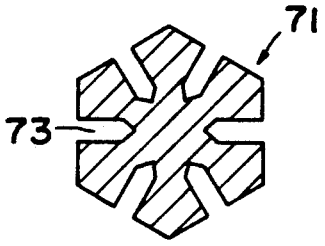
FIG. 15 is, similar to FIG. 5, a cross sectional view of the nib according to another embodiment of the invention.

FIG. 14, which is prepared for comparison only, shows a nib 61' which shows similarity as a analogous shape at its front portion relative to the other part thereof and which has the same minimum curvature portion B' as the minimum curvature portion B of the nib 61 of FIG. 12. However, the minimum curvature portion B' does not provide a capillary action which is as strong as that of the portion B of the nib 61 of FIG. 13. For example, with respect to the nib 51 shown in FIG. 11, it is desirable that the bottom of the ink passage 53 is formed smaller as it extends toward the writing point thereof. However, in order to provide a smooth writing action of the nib, i.e. surface finishing the writing nibs by tumbling them together in a barrel finishing operation tumbling can be performed so that a minimum curvature portion at the front end portion is consequently formed larger than that of the other rear part thereof.

The ink passages are not extended completely to the writing point but preferably are terminated at a portion which is slightly spaced from the writing point of the nib. If the nib has a plurality of ink passages, it is desirable that each of the ink passages has its own front end which is separated from the other passages rather than a structure in which the ink passages are connected together at the front end, because the nib of separated ink passages at the end thereof still provides a desirable ink feeding action and also provides a smooth writing action of the nib. As illustrated in FIG. 9, the nib has a gentle slope along the outer surface and along the bottom of the ink passages at the front portion 13 so that a front end of the ink passage 14 is located rearward by the distance "m" from the writing point of the nib 11.

This structure provides a smooth writing action of the nib.

Figure 16:
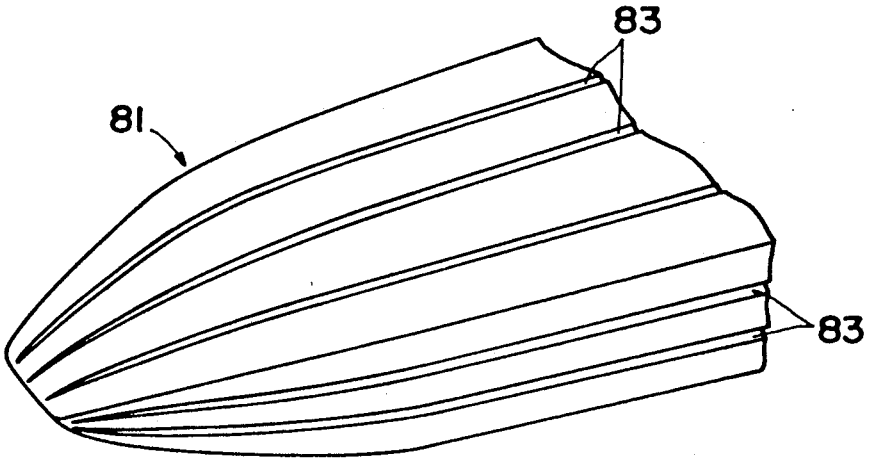
FIG. 16 is a perspective view of a part of the nib according to another embodiment of the present invention.

A shape of the nib according to the invention will be explained as follows. The above-described embodiments of the invention show writing nibs of a cannonball or circular shape having a tapered front portion, but a nib of a regular polygonal shape can also be used. If necessary, the nib may have a substantially rectangular cross section with its writing point tapered as illustrated in FIG. 16. The nib 81 in FIG. 16 has a plurality of ink passages 83 as illustrated. Though not illustrated, the nib may have other desirable shapes if necessary. For example, the nib may be eccentric or warped, not shown.

A preferred method for producing the nib according to the invention will be explained as follows.

It would be possible to produce the nib of the invention by merely sintering a product which has been injection molded, or carving a sintered ceramic product. However, these measures are not recommended since they are not suitable for a minute shape and constant measurements. For the nib of the invention, it is desirable to apply a stretching operation, which will be explained below.

First, materials to be prepared are a sintered powder and an excipient. As a sintered powder, various metal oxides such as aluminas (for example, $\alpha$-alumina, $\beta$-alumina, $\gamma$-alumina), silica, zirconia, silicon nitride, titanium carbide, clay mineral and boron nitride, nitrides, carbides, borides, fluorides, etc., and other material having a desired aspect ratio may be used alone or in combination. These materials preferably have an average particle size of 10 $\mu$m or less, and more preferably, 1 $\mu$m or less.

As an excipient, such materials which can be used, alone or in combination include polyethylene, polypropylene, polybutadiene, polyisobutylene, polystyrene, nylon, polymethyl methacrylate, polyethyl methacrylate, poly-$\alpha$-methylstyrene, polymethamethylstylene, polyvinylidene fluoride, polyvinyl fluoride, polytetrafluoroethylene, acetate, silicone varnish, silicone rubber, butyl rubber, polyvinyl chlorides, polyvinylidene chloride, chlorinated polyethylene, polyvinyl alcohol, carboxymethylcellulose, methylcellulose, polyvinyl acetate, polyvinyl butyral, polyvinylketone. The excipient is selected from the various materials so that it has an excipient function against a molded product not only before a stretching procedure but also after the stretching. A thermoplastic resin, particularly a crystalline one is one of preferable excipients. If necessary, a plasticizer, softener, solvent, stabilizer, etc. can be added such as dimethyl phthalate, dibutyl phthalate, diheptyl phthalate, dioctyl phthalate, di(2-ethylhexyl)phthalate, epoxidized soyabean oil, dioctyl adipate, dioctyl azelate, dioctyl sebacate, dibutyl sebacate, tricresyl phosphate, trioctyl phosphate, diethylene glycol dibenzoate, butyl phthalyl butyl glycolate, polyethylene glycol, palmitic acid, stearic acid, etc. Also, a sintering assistant can be used such as magnesia, which can be used as an excipient.

The ceramic material of the above-described material is formed into a product of a desired or a predetermined shape, and then treated with a partial stretching or formed process and a sintering process, to thereby obtain a writing nib, which will be described hereinafter.

Figure 6:
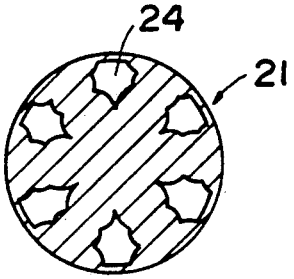
FIG. 6 is a cross sectional view taken along VI—VI in FIG. 2.
Figure 7:
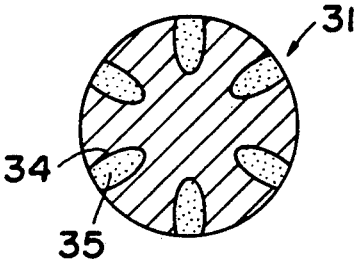
FIG. 7 is a cross sectional view taken along VII—VII in FIG. 3.
Figure 8:
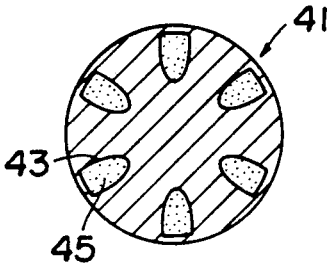
FIG. 8 is a cross sectional view taken along VIII—VIII in FIG. 4.

A longitudinal rod-like element, as a molded product, can be used which has a desired cross section as illustrated in FIGS. 5 and 6. The rod-like element having grooves or channels along its length can be readily produced by an extrusion process. Other examples of the molded product are shown in FIGS. 17 through 20. The molded product 101 shown in FIG. 17 has grooves 101*a* at a limited part thereof, the product 102 shown in FIG. 18 has channels 102*b* which are exposed to form opened grooves 102*a* at a predetermined portion, the product 103 shown in FIG. 19 has channels 103*b* which are connected to a recess 103*c* which receives another element such as an ink feeding element, and the molded product 104 shown in FIG. 20 is similar to that of FIG. 19 but it is formed with two elements, that is, one having channels 104*b* and the other having a recess. The channels 103*b*, 104*b* in the form of throughholes may be replaced with grooves. These molded products can be obtained by injection molding. The molded product 104 having two parts as illustrated in FIG. 20 can be formed integral by means of a sintering process.

Figure 21:
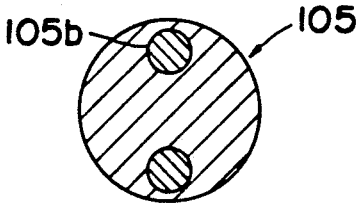
FIGS. 21 and 22 are cross sectional views, showing other examples of shape of the molded objects.
Figure 22:
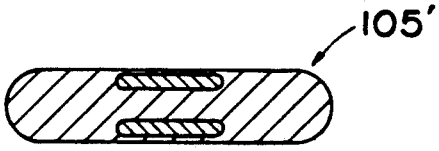

A ceramic material including a sintered powder having a relatively large particle size or a ceramic material including a relatively small amount of sintered powder may be filled in the grooves and channels of the molded product so that a similar nib as those of FIGS. 3 and 4 can be easily obtained. Namely, the ink passages 33, 43 of the nibs in the embodiments of FIGS. 3 and 4 can be formed not only by applying a secondary treatment or post handling to make them porous, but also by the method described above. The planar nib 81 shown in FIG. 16 may be formed by preparing a planar product, or by preparing at first a product having a circular cross section as shown in FIG. 21 and then pressed to form a planar product 105' as shown in FIG. 22. In FIG. 21, channels 105*b* are filled with a suitable depolymerizing resin, which is used for the purpose of preventing the channels 105 from being collapsed during a pressing process. The product 105 shown in FIG. 21 can be used without a pressing step if a nib of a circular cross section is to be produced.

A stretching process of the molded product will be explained. Various methods of stretching can be used in accordance with selected materials for the nib, composition rate of the materials, shape of the nib to be produced, and so forth. In the easiest manner, the stretching can be performed without applying thermal conditions. If an excessive force for the stretching is required, a plastic material or softening agent can be added. In the case where a thermoplastic resin is used as an excipient, the stretching can be performed while heating at a relatively low temperature. In a case where the molded product contains a thermosetting material or a photosetting material, the product portion or portions which will not be stretched can be heated or light-exposed so that non-stretched portions can be hardened relative to the portion which is to be stretched. By controlling a heated area, a desired shape of the nib may be obtained. If the heated area is small, a nib of a rapidly sloped or inclined surface may be obtained and, on the other hand, if the heated area is large, a nib of a gentle slope may be obtained.

A sintering operation will now be explained. The molded product, which was treated with stretching until, for example, it is divided into two parts or sections due to stretching is, cut into a predetermined dimension, dried and degreased, and then sintered. The sintered product is then treated by polishing to provide a nib having a smooth writing surface.

Examples of production of the nib will be described.

EXAMPLE 1

| | |
|---|---|
| α-alumina (average particle size: 0.5 μm maximum particle size: 3 μm) | 100 parts by weight |
| magnesia (average particle size: 1.3 μm maximum particle size: 5 μm) | 0.3 parts by weight |
| polyvinyl chloride | 15 parts by weight |
| dioctyl phthalate | 9 parts by weight |
| stearic acid | 2 part by weight |

The above described mixture was kneaded completely by a kneader at 125° C., and pelletized, and then molded by an extrusion molding machine to obtain a rod-like member having a cross sectional shape of FIG. 5. An outer diameter of the rod-like member was 3.2 mm. This rod-like member was stretched as set forth below.

A commercially available hair drier was used to blow heated air to the above-described rod-like member having 10 mm in length for 7 seconds while the rod-like member is rotated once per second, and then the rod-like member is removed from the heated air and is positioned on a base member of polyester which has a longitudinal groove. The rod-like member was stretched in opposite directions at a speed of about 5 cm/second using the direction of the longitudinal groove as a guide. At the time of the heating by the hair dryer, the temperature of the rod-like member where the hair dryer was located was about 130° C.

The stretching was carried out so that the rod-like member of 10 mm in length was stretched to the length of 20 mm, and then degreased at 1100° C. for 20 hours, and thereafter sintered at 1600° C. for 1 hour. After natural cooling, it was found that the rod-like member had a length of 16.5 mm and an outer diameter of 2.6 mm.

The rod-like member is then treated with a sandcloth at its tip or front end, and then tumbled. The member is then buffed at its front end and treated with a grinder at its rear end until it has a length of 10 mm. Thus, a nib for a writing instrument is completed. The thus formed nib is assembled in a various known type of writing instrument such as the writing instrument shown in FIG. 26. The nib provided a desirable ink feeding action and smooth writing operation without blocking of the ink passages by foreign particles.

EXAMPLE 2

A nib was produced in a manner similar to the method of Example 1 except that the rod-like member had a cross sectional shape as illustrated in FIG. 6. By tumbling, the ink channel 24 in the form of a through-hole was shaped into a groove for the length of about 1.5 mm from the end of the through-hole at the front portion of the nib.

EXAMPLE 3

A nib was produced in a manner similar to the method of Example 1 except that the rod-like member was twisted in the process of stretching so that spiral ink passages were formed.

EXAMPLE 4

By extrusion molding, a rod-like member having a circular cross sectional shape with a diameter of 3.2 mm was produced. This rod-like member was provided with six grooves 101*a*(FIG. 17) along its length, the grooves each having a length of 20 mm, a width of 1.3 mm and a depth of 0.8 mm. The other steps of the process were similar to that of Example 1.

EXAMPLE 5

A nib was produced in a manner similar to the method of Example 4 except that the product was stretched to a length of about 50 mm, and that the sintered product was not treated with the grinder at the rear end of the product. The nib was used for a pen which does not have an ink reservoir therein but is used by dipping the nib into a separate ink vessel, and the nib showed a desired writing effect.

EXAMPLE 6

A nib was produced in a manner similar to the method of Example 1 except that the quantity of dioctyl phthalate was increased to 9 parts by weight and a rod-like member 102 (FIG. 18) was formed by injection molding, and that a stretching process was carried out without heating.

EXAMPLE 7

Figure 19:
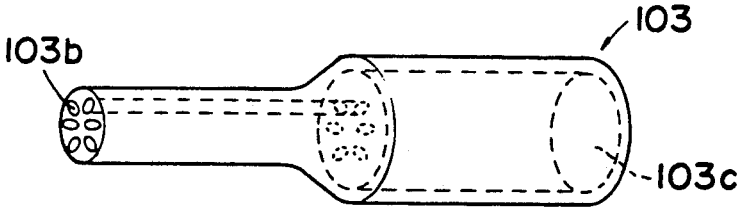
Figure 20:
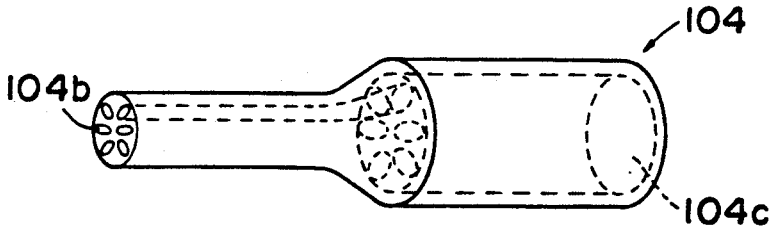

A product illustrated in FIG. 19 was formed by injection molding in a manner similar to the method of Example 6. The product had a thick portion having a diameter of 3.2 mm and a thin portion having a diameter of 1.6 mm and a length of about 15 mm. The product was stretched after a portion between the thin and thick portions was heated. After stretching, the thick portion was sintered but not treated with a grinder at its rear end. Other process steps were similar to that of Example 6.

EXAMPLE 8

A rod-like member 104(FIG. 20) was prepared by injection molding such that the member 104 consists of two parts, that is, a thin portion and a thick portion. After the two parts are joined together, a small amount of methyl ethyl ketone was applied to the joined portion, and then the joined product was treated by stretching. Other process steps were similar to that of Example 7.

EXAMPLE 9

A rod-like member 105 shown in FIG. 21 was prepared with the ink passages filled with a filler of polyvinyl chloride, and then pressed to have a rectangular shape in cross section as shown in FIG. 22. The thus formed planar member 105' was then stretched to form a nib according to the invention.

The writing nibs produced by Examples 1–9 displayed smooth writing ability and reliable ink feeding action.

Assembly of the nib according to the invention will be described with reference to FIGS. 23–25.

Figure 23:
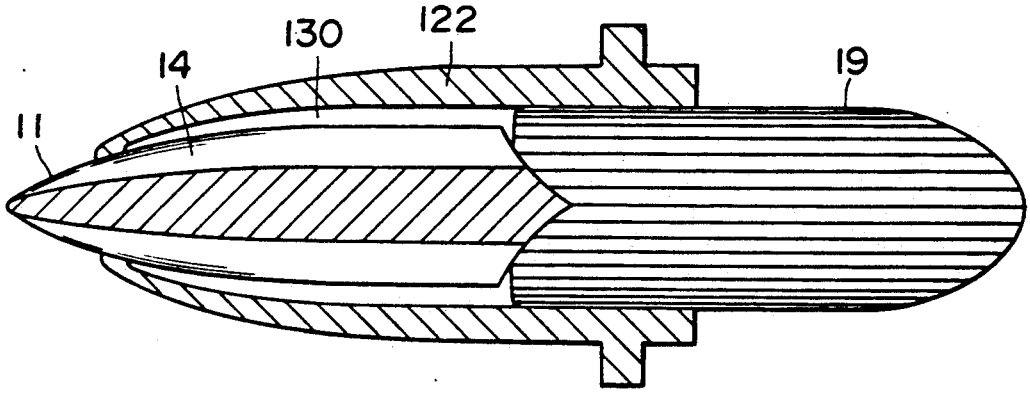
FIGS. 23, 24 and 25 are longitudinally sectional views, showing examples of an assembly of the nib into writing instrument body.

In FIG. 23, the writing nib 11 shown in FIG. 1 is used. The nib 11 is tapered at its rear end and connected to an ink feed core 19 made of, for example, a fiber bundle. The ink feed core 19 is connected to another element such as an ink filler or an ink feeder having annular grooves therearound, not shown. Reference numeral 122 represents a holder for securing a nib-holding tip, which will be described presently with reference to FIG. 26. In the structure of FIG. 23, an annular and longitudinal air space 130 is provided between the holder 122 and the nib 11. The air space 130 functions to connect the ink grooves 14 with each other so that a stable ink feeding operation is ensured.

Figure 24:
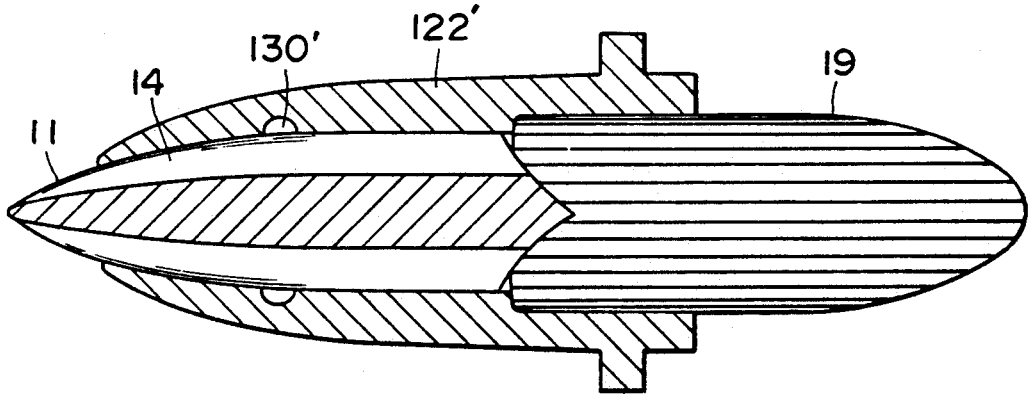

FIG. 24 shows a modified structure, in which an air space 130' is formed on a part of the inner surface of the holder 122'. Alternatively, the air space 130' can be formed on the surface of the nib 11, not shown.

Figure 25:
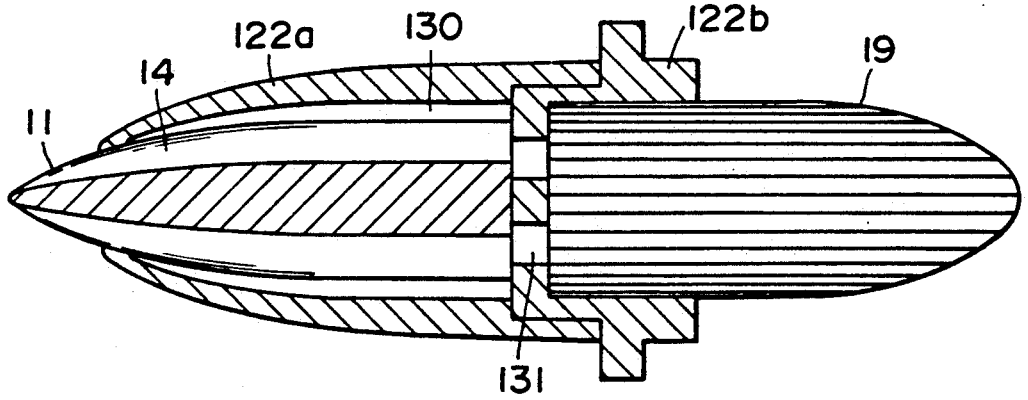

FIG. 25 shows a further modification in which the tip holder 122 has front holder portion **122*a* and a rear holder portion 122*b*. The rear holder portion 122*b* receives the ink feed core 19 and contacts a rear flat end of the nib 11 so that the ink passage 14 of the nib is connected to the ink feed core 19 through apertures 131 in the rear holder portion 122*b***.

Figure 26:
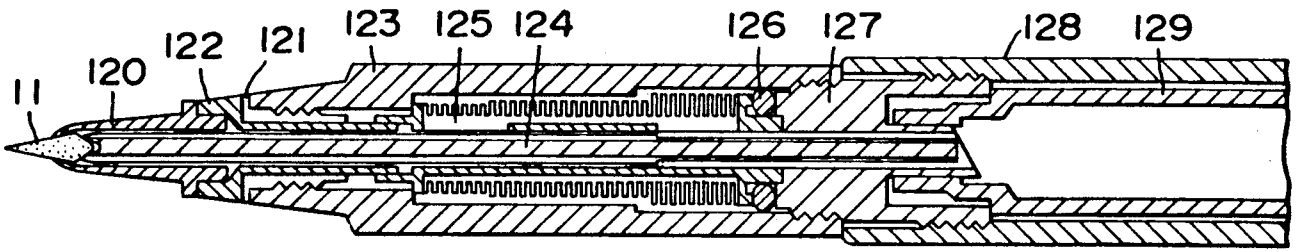
FIG. 26 is a longitudinally sectional view of a writing instrument, showing the nib of the invention adapted to an instrument body.
Figure 17:
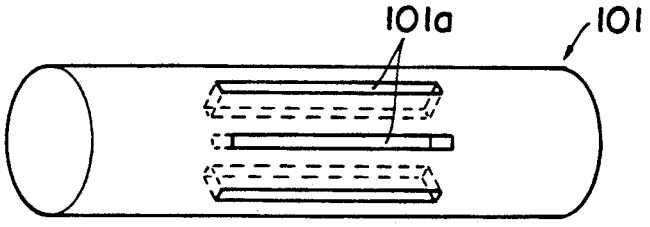
FIGS. 17 through 20 are perspective views showing examples of molded objects which are used for producing the nib according to the invention.
Figure 18:
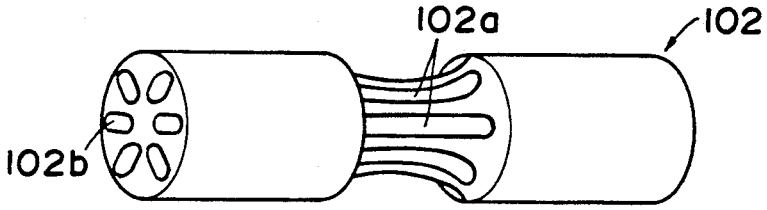

FIG. 26 shows an example of a writing instrument to which the nib according to the present invention is applied. For the purpose of simplification, the nib is designated by reference numeral 11 which is the nib shown in FIG. 1 although every other type of nib of the present invention can be used. In FIG. 26 of the drawing, the writing instrument has a front casing 123 and a rear casing 128 which is connected to the front casing 123 through a connector 127 to form a tubular casing for the writing instrument. The front casing is connected to a tip holder 122 which holds a tip 120. As illustrated, the tip 120 secures the nib 11 of the invention such that the nib 11 is connected to a longitudinal ink feed core 124 which extends through an ink feeder 125 having a plurality of annular grooves. Reference numerals 121 and 126 designate an air vent and O-ring, respectively. The rear casing 128 has an ink reservoir 129 which receives at its front end a rear end of the ink feed 124. The writing instrument illustrated in FIG. 26 is an example, and other types of writing instruments can be used if desired.

Although the present invention has been described with reference to the preferred embodiments, many modifications and alterations can be made within the spirit of the present invention.

What is claimed is:

1. A nib for a writing instrument, said nib comprising: a ceramic nib body terminating at a writing point and having a tapered portion tapering in a direction toward said writing point such that the outer surface of said nib body at the tapered portion thereof converges toward said writing point, and said nib body defining at least one ink passage therein which contains a porous material, said at least one ink passage having a bottom defined by a surface of the nib that extends along said tapered portion of the nib body in a direction toward said writing point such that said at least one ink passage converges along with the outer surface of said nib body toward said writing point, the depth of said at least on ink passage becoming shallower along said tapered portion in a direction toward said writing point until the surface defining the bottom of said at least one ink passage merges with the outer surface of the nib body whereat said at least one ink passage terminates, and the surface of the nib defining the bottom of said at least one ink passage having a minimum curvature portion which establishes the angular extent subtended by said passage thereabout in each cross section of the passage taken in a plane perpendicular to the longitudinal axis of said nib body, said minimum curvature portion having a degree of curvature that decreases along said tapered portion in a direction toward said writing tip such that said angular extent subtended by said passage also decreases toward said writing tip.

2. A nib for a writing instrument according to claim 1, wherein said nib body has a porosity of less than about 10%.

3. A nib for a writing instrument according to claim 1, wherein said nib body has a plurality of surfaces defining opposed sides of said at least one passage, and projections extending circumferentially from and at an angle to the surfaces defining said opposed sides at radially outermost portions thereof such that said ink passage is narrower between said projections than between said sides thereof, said projections being formed at a rear portion of said nib body which is distal to said tapered portion of said nib body.

4. A nib for a writing instrument according to claim 1, wherein said nib body has an angular portion defining the bottom of said at least one ink passage.

5. A nib for a writing instrument according to claim 1, wherein said nib body has a writing tip end defining said writing point, said tip end having a longitudinal cross section which is substantially circular.

6. A nib for a writing instrument according to claim 1, wherein said tapered portion has a substantially regular polygonal cross section.

7. A nib for a writing instrument according to claim 1, wherein said tapered portion has a cross-sectional shape having two sides parallel to each other.

8. A nib for a writing instrument according to claim 1, wherein the surface defining the bottom of said at least one ink passage and the outer surface of the nib body merge at a location spaced longitudinally of the nib body from said writing point.

9. A nib for a writing instrument according to claim 1, wherein the surface defining the bottom of said at least one ink passage extends longitudinally toward said writing point along a curvilinear path over said tapered portion of the nib body.

* * * * *